US011421539B2

(12) United States Patent
Renaud et al.

(10) Patent No.: US 11,421,539 B2
(45) Date of Patent: Aug. 23, 2022

(54) ASSEMBLY FOR AXIAL TURBOMACHINE, ASSOCIATED AXIAL TURBOMACHINE, ASSEMBLY METHOD, AND SEALING JOINT

(71) Applicant: SAFRAN AERO BOOSTERS SA, Herstal (BE)

(72) Inventors: Mathieu Renaud, Liège (BE); Alain Derclaye, Couthuin (BE); Sébastien Vacca, Esneux (BE)

(73) Assignee: SAFRAN AERO BOOSTERS SA, Herstal (BE)

( * ) Notice: Subject to any disclaimer, the term of this patent is extended or adjusted under 35 U.S.C. 154(b) by 234 days.

(21) Appl. No.: 16/644,359

(22) PCT Filed: Aug. 30, 2018

(86) PCT No.: PCT/EP2018/073321
§ 371 (c)(1),
(2) Date: Mar. 4, 2020

(87) PCT Pub. No.: WO2019/105610
PCT Pub. Date: Jun. 6, 2019

(65) Prior Publication Data

US 2021/0062662 A1 Mar. 4, 2021

(30) Foreign Application Priority Data

Nov. 30, 2017 (BE) ..... 2017/5874

(51) Int. Cl.
*F01D 11/00* (2006.01)
*F01D 9/04* (2006.01)
(Continued)

(52) U.S. Cl.
CPC ..... *F01D 9/041* (2013.01); *F01D 9/042* (2013.01); *F01D 11/005* (2013.01);
(Continued)

(58) Field of Classification Search
CPC ..... F01D 11/005; F01D 9/042; F01D 25/06; F05D 2230/642; F05D 2240/12;
(Continued)

(56) References Cited

U.S. PATENT DOCUMENTS

2013/0266437 A1* 10/2013 Vatin ..... F04D 29/542 415/208.1
2016/0258297 A1* 9/2016 Cortequisse ..... F01D 5/282
(Continued)

FOREIGN PATENT DOCUMENTS

EP 2738356 A1 6/2014
EP 2930308 A1 10/2015
EP 3064708 A1 9/2016

OTHER PUBLICATIONS

International Search Report dated Nov. 21, 2018 for Parent PCT Appl. No. PCT/EP2018/073321.

*Primary Examiner* — Eldon T Brockman
*Assistant Examiner* — Danielle M. Christensen
(74) *Attorney, Agent, or Firm* — James E. Walton

(57) ABSTRACT

Assembly for axial turbomachine, in particular for an aircraft turbojet, the assembly comprising: an annular casing with an internal surface (40); an annular row of stator baffles (26) with at least one stator baffle (26) comprising an airfoil (50) which extends radially from a fixing platform (34), the fixing platform (34) being fixed to the casing and having a polygonal outline; characterised in that it further comprises a gasket (80) comprising a frame, the outline of which conforms to the polygonal outline of the fixing platform (34), the frame being in radial contact with the fixing platform (34) and the casing in order to ensure a seal.

17 Claims, 5 Drawing Sheets

(51) Int. Cl.
*F01D 17/16* (2006.01)
*F01D 25/24* (2006.01)
*F04D 29/56* (2006.01)

(52) U.S. Cl.
CPC ..... *F01D 17/162* (2013.01); *F01D 25/24* (2013.01); *F04D 29/563* (2013.01); *F05D 2220/323* (2013.01); *F05D 2240/12* (2013.01); *F05D 2250/232* (2013.01); *F05D 2250/241* (2013.01)

(58) Field of Classification Search
CPC ..... F05D 2250/232; F05D 2250/241; F05D 2260/37; F04D 29/563; F04D 29/644
See application file for complete search history.

(56) References Cited

U.S. PATENT DOCUMENTS

2017/0248029 A1* 8/2017 Hafner ..... F01D 25/12
2018/0172026 A1* 6/2018 Urac ..... F04D 29/644

* cited by examiner

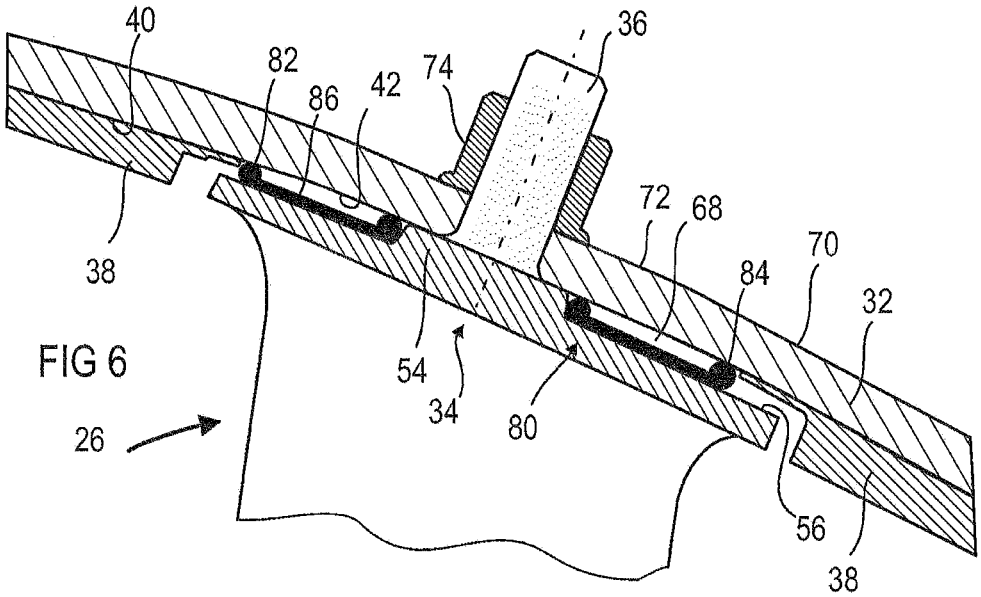
FIG 6
FIG 7
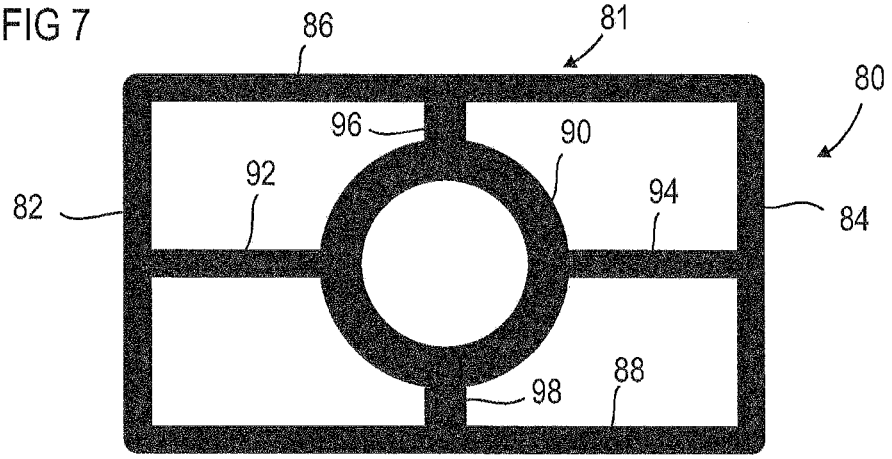
FIG 8
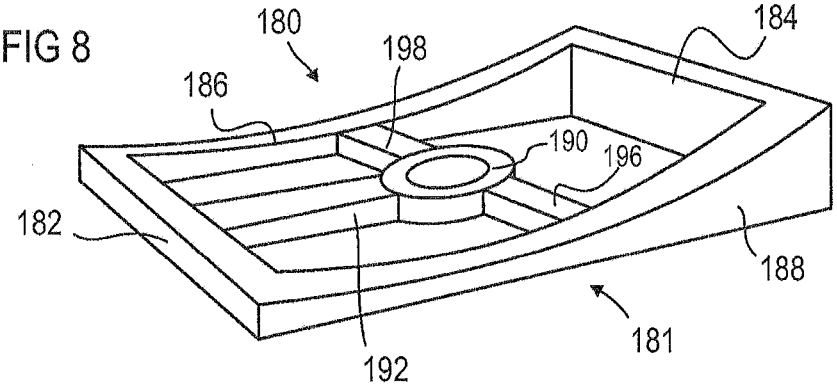

ASSEMBLY FOR AXIAL TURBOMACHINE, ASSOCIATED AXIAL TURBOMACHINE, ASSEMBLY METHOD, AND SEALING JOINT

TECHNICAL FIELD

The invention relates to an axial turbine engine assembly. More specifically, the invention relates to a turbine engine casing and a vane provided with a platform at one of its radial ends. The invention also relates to a turbine engine with such an assembly.

BACKGROUND ART

Document EP 2 930 308 A1 depicts a turbine engine compressor wherein the wall of the casing is made of composite material and has, on its internal surface, planar facets for fixing the stator vanes. To this end, the vanes are provided with platforms arranged at the outer radial end of each vane, each of the platforms coming into contact with a facet. This makes it possible to reduce the stress concentrations between the wall of the casing and the vanes. A layer of abradable material is provided on the internal face of the wall of the casing. This layer of abradable material is arranged between the platforms and ensures the continuity of the air flow guide surface. However, it appears that this arrangement is insufficient to seal the flow, and in particular air leaks can appear under certain pressure and temperature conditions, between the platforms and the wall of the casing. This mainly impacts the performance of the turbine engine and can affect the durability of the mechanical strength of the vane attachment.

SUMMARY OF THE INVENTION

Technical Problem

The invention aims to solve at least one of the problems encountered in the prior art. More specifically, the invention aims to increase the efficiency of the turbine engine and to ensure the reliability of the attachment of the vanes to the casing.

Technical Solution

The invention relates to an assembly for an axial turbomachine, in particular an aircraft turbojet engine, the assembly comprising: an annular casing with an internal surface; an annular row of stator vanes with at least one stator vane comprising an airfoil extending radially from a fixing platform, said fixing platform being fixed to the casing and having a polygonal outline; remarkable in that it further comprises a gasket comprising a frame whose outline matches the polygonal outline of the fixing platform, said frame being in radial contact with the fixing platform and with the casing in order to seal one to the other.

The vane and the platform can be integrally made. The casing can be at least partially made of composite material with an organic matrix.

According to a preferred embodiment of the invention, the frame sealingly defines a pocket arranged radially between the fixing platform and the casing, said pocket extending in particular over the majority of the fixing platform.

According to a preferred embodiment of the invention, the frame is formed by bars running along the sides of the platform.

According to a preferred embodiment of the invention, the frame of the gasket has a general external shape as a parallelogram and preferably a rectangle. Alternatively, the shape can be trapezoidal, oval, round, etc. Preferably, the general external shape of the gasket corresponds to the shape of the platform, seen in a section in a plane orthogonal to the radial orientation of the vane.

According to a preferred embodiment of the invention, the platform has a fixing pin which passes through a hole in the casing, and in that the fixing pin passes through the gasket.

According to a preferred embodiment of the invention, a portion of the gasket is toric or cylindrical, and surrounds the fixing pin. The toric portion can be oval, elliptical or circular.

According to a preferred embodiment of the invention, segments connect the toric or cylindrical portion to the frame.

According to a preferred embodiment of the invention, the segments comprise two circumferential segments oriented in the circumferential direction of the turbomachine and at least one axial segment oriented in the axial direction of the turbomachine.

According to a preferred embodiment of the invention, the circumferential segments comprise a larger cross-section than the axial segment, the circumferential segments having an axial dimension larger than the circumferential dimension of the axial segment. The thickness of the circumferential and axial segments in the radial direction can be the same. The axial dimension of the circumferential segments and/or the circumferential dimension of the axial segments may be greater than the thickness of the segments.

According to a preferred embodiment of the invention, the toric or cylindrical portion is enclosed in the upstream half of the gasket.

According to a preferred embodiment of the invention, the gasket comprises a downstream reinforcement strip, preferably extending mainly in the circumferential direction of the turbomachine.

According to a preferred embodiment of the invention, the gasket is at least partially made of foam, polymer and/or elastomer.

According to a preferred embodiment of the invention, the fixing platform is a platform of a first vane, the gasket being in contact with an identical gasket associated with a platform of a second vane, adjacent to the first platform. In particular, when the gaskets have a parallelogram shape, they may each have two sides oriented along the axis of the turbomachine, each of the sides being in contact with one side of the gasket of the adjacent platform.

According to a preferred embodiment of the invention, the gasket is arranged between the casing and several platforms of adjacent vanes, said gasket conforming to the polygonal outlines of each of said several platforms of adjacent vanes. For example, several adjacent pairs of platforms and facets can share the same gasket.

According to a preferred embodiment of the invention, the casing comprises an internal surface with an annular row of facets receiving the stator vanes, the external radial surface of the platform being inclined relative to the associated facet and/or the radial thickness of the gasket is greater downstream than upstream. Due to the non-direct contact between the two respective surfaces of the platform and the facet, they may not be parallel because they are not in contact with each other. Thus, it is possible, but not essential, for the gasket to have a greater thickness downstream than upstream, that is to say where the pressure of the air flow is greatest.

According to a preferred embodiment of the invention, a layer of abradable material is provided on the internal face of the casing, in particular upstream and/or downstream of the facets, and at an axial distance from the platforms and/or the gasket.

The invention also relates to an axial turbomachine with a low-pressure compressor, remarkable in that the compressor comprises an assembly according to one of the embodiments set out above and in that the casing is at least partially made of composite material with organic matrix in contact with the gasket.

The invention also relates to a method of assembling an assembly for a turbomachine, remarkable in that the assembly is one of the embodiments set out above and in that the method comprises a step (A) fitting the gasket between the casing and the platform of the vane, and a step (b) of fixing the vane to the casing during which gasket is compressed radially between the platform of the vane and the casing.

According to a preferred embodiment of the invention, the gasket is more compressed downstream than upstream.

According to a preferred embodiment of the invention, the fixing step (b) comprises the tightening of a nut on the fixing pin so as to generate the compression of the gasket.

In order to better maintain the gasket during assembly, it may be useful for it to be provided with means allowing it to adhere to the platform before it is assembled to the casing.

Thus, the invention also relates to a gasket for a platform for fixing a stator vane of an axial turbomachine, in particular of an aircraft turbojet engine, said fixing platform having a polygonal outline, the gasket comprising: a frame whose outline is able to match the polygonal outline of the fixing platform, and thermoformed studs.

According to a preferred embodiment of the invention, the studs are molding inserts of the gasket.

According to a preferred embodiment of the invention, the studs include holes, preferably through-holes, capable of cooperating with pins provided on the platform.

The invention also relates to a gasket for a platform for fixing a stator vane of an axial turbomachine, in particular of an aircraft turbojet, said fixing platform having a polygonal outline, the gasket comprising: a frame the outline of which is adapted to match the polygonal outline of the fixing platform, and an adhesive element at least on part of the frame.

According to a preferred embodiment of the invention, the adhesive element is an adhesive layer provided on the part of the frame adapted to come into contact with the platform.

According to a preferred embodiment of the invention, the adhesive element is covered with a lid.

According to a preferred embodiment of the invention, the assembly method is remarkable in that the gasket is according to one of the embodiments set out above, step (a) of setting place of the gasket between the casing and the vane platform comprising a sub-step of pre-assembly of the gasket to the platform.

According to a preferred embodiment of the invention, the pre-assembly sub-step comprises the fixing of the studs to pins provided on the platform.

According to a preferred embodiment of the invention, the pre-assembly sub-step comprises the removal of the lid and the fixing by adhesion of the gasket to the platform via the adhesive element.

According to a preferred embodiment of the invention, the platforms of the vanes comprise sides of polygons in contact with each other.

According to a preferred embodiment of the invention, the polygonal outline of the platform encircles the outline of the frame.

According to a preferred embodiment of the invention, the frame forms a continuous loop, and/or the outline is closed.

According to a preferred embodiment of the invention, the gasket, in particular the frame, forms a closed and sealed loop which is inscribed in the polygonal outline of the fixing platform.

According to a preferred embodiment of the invention, the loop is in radial contact with the platform and the casing over its entire circumference.

The invention also relates to an assembly for a turbomachine, the assembly comprising an external casing and a stator vane including an annular row of identical stator vanes, at least one stator vane comprising a fixing platform fixed against the surface. internal of the casing, and an airfoil extending radially from the platform; remarkable in that it further comprises a gasket forming an outer edge of the platform, and/or a gasket forming a bead along the outline of the platform; said gasket being in contact with the platform and the casing.

According to another aspect, the invention relates to an axial turbomachine assembly, in particular an aircraft turbojet engine, the assembly comprising: a casing comprising a tubular wall having planar facets on its internal surface, each facet comprising at least one orifice; at least one annular row of stator vanes each comprising an airfoil extending substantially radially and a fixing platform at the outer radial end of the airfoil; each vane attachment platform comprises an attachment pin passing through an associated facet, the assembly being remarkable in that a gasket penetrated by the attachment pin is provided on the platform.

According to another aspect, the invention relates to an assembly of an axial turbomachine, in particular of an aircraft turbojet engine, the assembly comprising: a vane provided with an airfoil and a platform for attachment to a ferrule or to a casing, the airfoil having a leading edge, a trailing edge and a camber line connecting the leading edge to the trailing edge; the assembly being remarkable in that it comprises a gasket capable of coming into contact with a surface of the platform and a surface of said ferrule or said casing, the gasket having a thickness which varies according to the direction of the camber line.

Benefits

The presence of the gasket allows a simpler and more flexible design: the layer of abradable material which must be contiguous to the platform in known systems can be positioned remotely because the layer is no longer essential for the sealing function. Also, the precision of machining and positioning of the surfaces of the facets and the platforms of the vanes is no longer as important because the manufacturing tolerances can be widened thanks to the presence of the seal.

BRIEF DESCRIPTION OF THE DRAWINGS

FIG. 6 shows a portion of the casing wall on which is fixed a vane;

FIG. 7 shows a top view of an embodiment of a gasket;

FIG. 8 shows an isometric view of a gasket according to a second embodiment;

DESCRIPTION OF PREFERRED EMBODIMENTS

In the following description, the terms "internal" and "external" refer to a positioning relative to the axis of rotation of an axial turbomachine. The axial direction is along the axis of rotation, and the radial direction is perpendicular to the axial direction. The lateral direction is considered along the circumference, and can be perpendicular to the axis.

Figure 1:
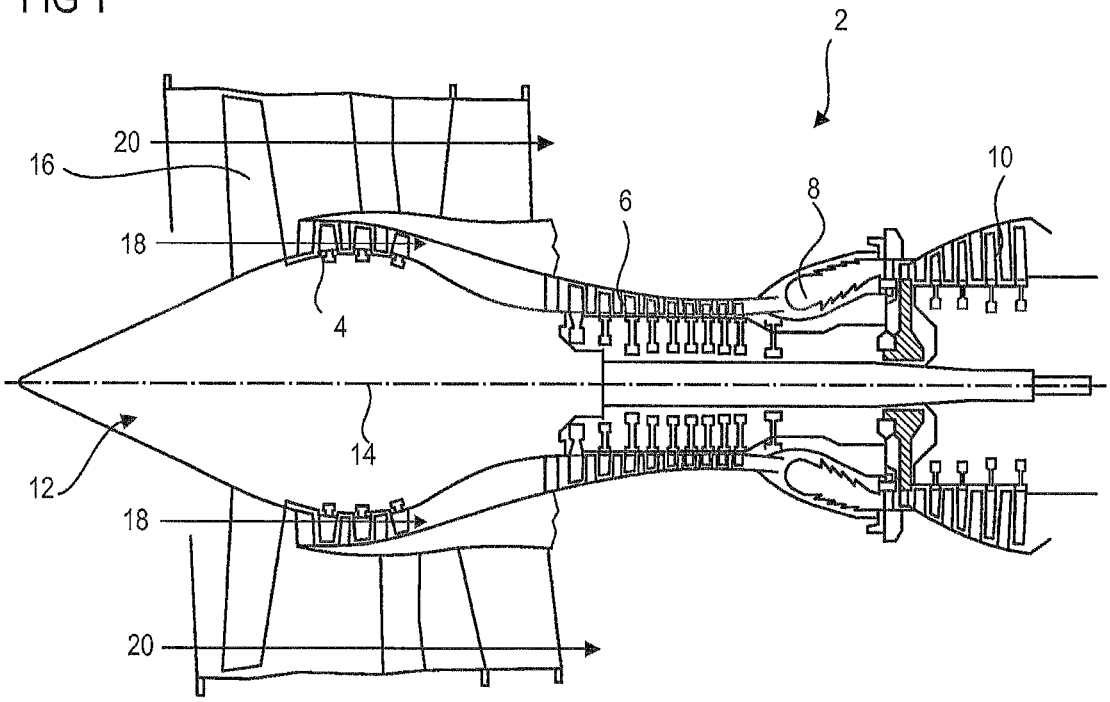
FIG. 1 shows an axial turbomachine according to the invention.

FIG. 1 represents a double-flow turbojet engine 2 (turbomachine). The turbojet engine 2 comprises a low-pressure compressor 4, a high-pressure compressor 6, a combustion chamber 8 and a turbine 10. In operation, the mechanical power of the turbine 10 transmitted via the central shaft to the rotor 12 sets in motion the two compressors 4 and 6.

The compressors have several rows of rotor blades associated with rows of stator vanes. The rotation of the rotor around its axis of rotation 14 thus makes it possible to generate a flow of air progressively compressed up to the combustion chamber 8.

A fan 16 is coupled to the rotor 12 and generates an air flow which is divided into a primary flow 18 and a secondary flow 20. The primary flow 18 and secondary 20 are annular flows, they are channelled by cylindrical partitions, or ferrules, which can be interior and/or exterior.

Figure 2:
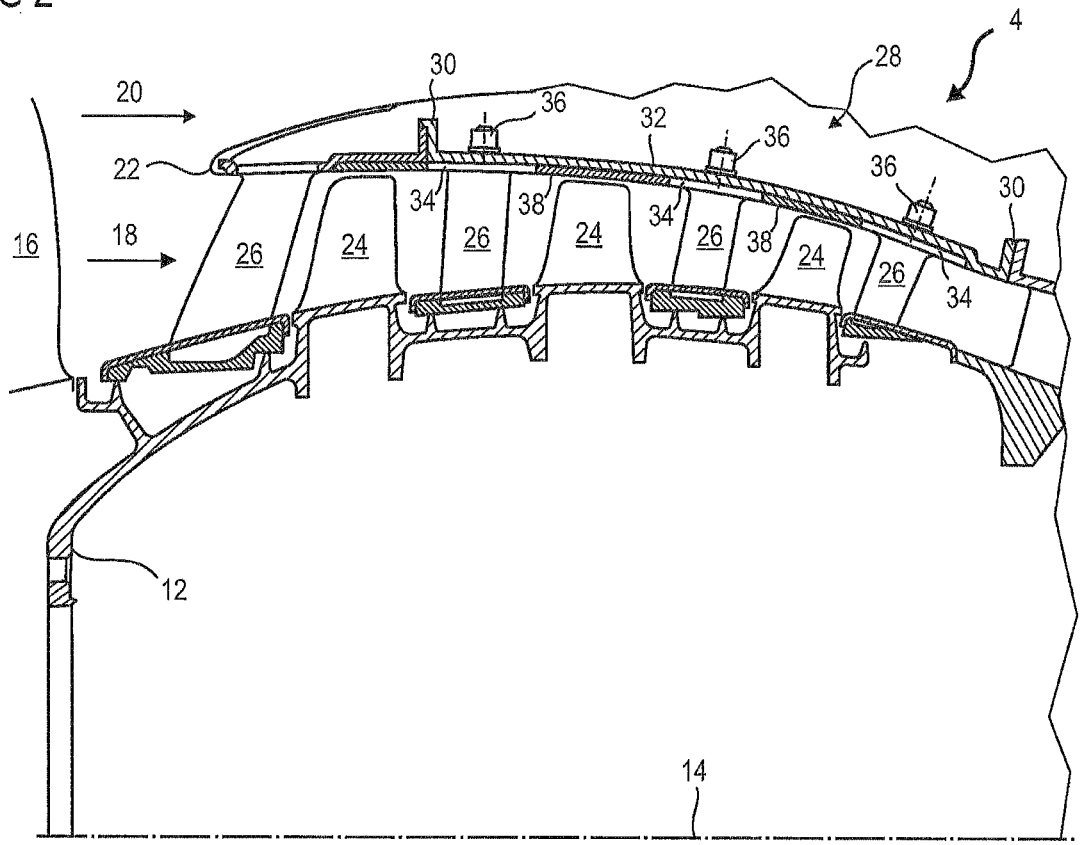
FIG. 2 is a diagram of a turbomachine compressor.

FIG. 2 is a sectional view of a compressor of an axial turbomachine such as that of FIG. 1. The compressor can be a low-pressure compressor 4. We can see part of the fan 16 and the separation nozzle 22 for the primary flow 18 and the secondary flow 20. The rotor 12 can comprise several rows of rotor blades 24.

The low-pressure compressor 4 comprises at least one rectifier which contains an annular row of stator vanes 26. Each rectifier is associated with the fan 16 or with a row of rotor vanes 24 to straighten the air flow, so as to convert the velocity of the flow into pressure.

The compressor comprises at least one casing 28. The casing 28 may have a generally circular or tubular shape. It can be an external compressor casing and can be made of composite materials, which makes it possible to reduce its mass while optimizing its rigidity. The casing 28 may include fixing flanges 30, for example annular fixing flanges 30 for fixing the separation nozzle 22 and/or for fixing the casing 28 to an intermediate fan casing of the turbomachine. The casing then performs a function of mechanical link between the separation nozzle 22 and the intermediate casing 32. The casing also performs a function of centering the separation nozzle 22 relative to the intermediate casing, for example using its annular flanges. The annular flanges 30 can be made of composite material and can include fixing holes (not shown) to allow assembly through bolts, or lockbolts. The flanges 30 may include centering surfaces, such as centering holes.

The casing 28 may comprise a wall 32 shape generally as a circle or an arc, the axial edges of which may be delimited by the flanges 30. The wall 32 may have a symmetry of axis around the axis of rotation 14. The wall 32 can be made of composite material, with a matrix and a reinforcement. The wall 32 may have the shape of an ogive, with a variation in radius along the axis 14.

The casing can be formed of half-shells or half-casings, which are separated by an axial plane. The half-shells are connected using axial flanges.

The stator vanes 26 extend essentially radially from the wall 32, at the position of annular zones for receiving vanes. These zones may include fixing means such as annular grooves, or fixing orifices. The vanes 26 can be attached to the wall individually, or form segments of vanes attached to the wall 32 The wall forms a mechanical link between several vanes of different rows and/or of the same row of vanes.

The stator vanes 26 each comprise a fixing platform 34, possibly provided with fixing pins 36 such as threaded rods or any other equivalent means. The wall may comprise annular layers of abradable material 38 between the platforms 34 of the vanes, so as to form a barrier between the primary flow 18 and the wall 32.

The casing 28, or at least its wall 32, can be made of a composite material. The composite material can be produced using a pre-impregnated fiber reinforcement which is hardened by autoclave or by injection. The injection can consist of impregnating a fibrous reinforcement with a resin, possibly organic, such as epoxy. The impregnation can be according to a process of the RTM type (Resin Transfer Molding).

The fibrous reinforcement can be a woven preform, possibly in three dimensions, or can comprise a stack or a winding of different fibrous sheets or fibrous folds, which can extend on the wall, and on at least one or more flanges. The plies can include carbon fibers, and/or graphite fibers, and/or glass fibers to avoid galvanic corrosion, and/or kevlar fibers, and/or carbotitanium fibers. Thanks to the materials mentioned, a turbomachine casing can measure between 3 and 5 mm thick for a diameter greater than 1 meter.

Figure 3:
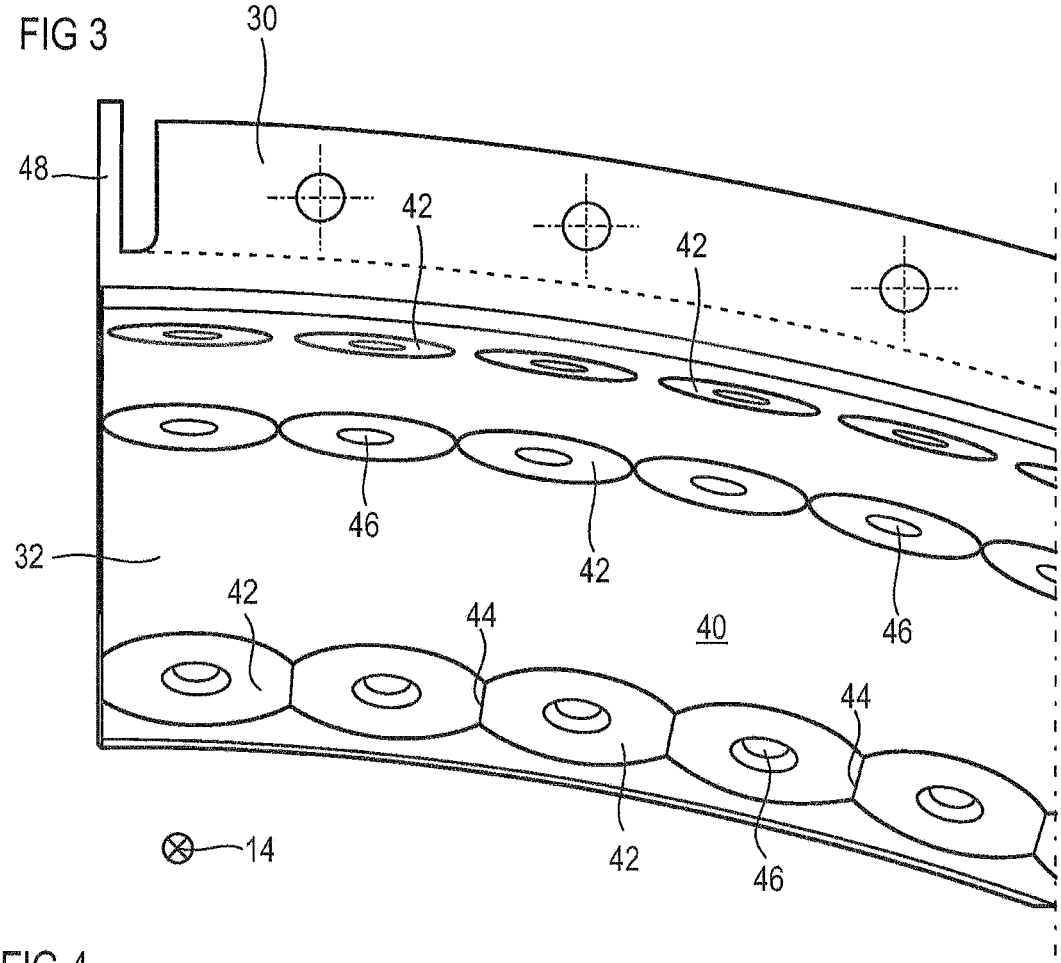
FIG. 3 outlines an axial view of the turbomachine compressor casing according to the invention.

FIG. 3 shows a half-shell of the axial turbine casing, for example of an external compressor casing, possibly low-pressure compressor. The casing is viewed axially from upstream. The present teaching can be applied to any casing of the turbomachine, such as a fan casing or a turbine casing.

The wall 32 has a curved internal surface 40. The internal surface 40 may include a continuous curvature along the circumference of the circular wall and/or in the axial direction. The internal surface 40 may be circular around the axis of rotation 14 of the turbomachine, and possibly opposite said axis. The wall 32, or at least the internal surface 40 may be annular, possibly generally tubular. Depending on the circumference, the curvature of the internal surface 40 can be monotonous, and possibly constant. The curvature can vary axially, for example being more curved (smaller radius of curvature) downstream. The internal surface 40 can be a conical surface portion, a spheroid surface portion, possibly spherical, or a combination of each of these surfaces.

The wall 32 may include facets 42, possibly arranged in at least one annular row along the circumference of the wall 32. Each facet 42 defines a flat surface. The facets 42 of a row can be regularly distributed angularly. The wall 32 may comprise several annular rows of facets 42 spaced axially along the wall 32. At least one or each facet 42 is flush with the internal surface 40 of the wall. By "flush" it can be understood that a facet is levelled, and/or extends, and/or touches the internal surface.

The facets 42 may have different shapes, possibly the facets of the same row have the same shape. Each row can have different shapes of facets. The facets 42 may have disc shapes, oval shapes. The average diameters of the facets 42 can vary gradually, they can increase towards the end of the wall 32 having a minimum diameter, which in the example illustrated in FIG. 2 is the direction from upstream to downstream.

The facets 42 of the same row can be distant from one another. They can then be separated by internal surface portions 40 which have continuous curvatures. Each facet 42 of the same row can be surrounded by the internal surface 40. The facets 42 of the same row can be tangent to each other, they can be in contact at contact points. Alternatively, the facets of the same row can be cut laterally. These facets can be joined along junction lines 44.

One or each facet 42 may comprise a fixing means, such as a fixing orifice 46, which can cooperate with a vane fixing pin. Preferably, each fixing orifice 46 is disposed at the center of the associated facet. The fixing orifices 46 can be arranged in one or more annular row (s). These can be distributed axially along the wall 32.

At least one or each axial flange 48 may be integral with the wall 32, as well as at least one or each annular flange 30. Alternatively, at least one type of flange, or each flange may be attached to the wall. For example, the wall can be made of composite material and the flanges can be metallic and fixed to the wall.

Figure 4:
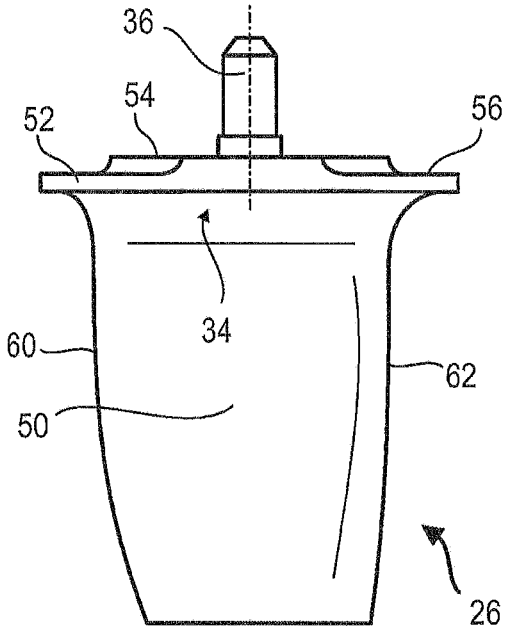
FIG. 4 illustrates a stator vane with a platform in contact with a facet of the casing.

FIG. 4 represents a turbomachine vane, for example a stator vane 26 of a low-pressure compressor rectifier. The vane can also be a turbine vane.

The vane 26 comprises a body, or airfoil 50, forming a profiled surface intended to extend in the primary flow. Its shape allows to modify the air flow. The airfoil extends axially from a leading edge 60 to a trailing edge 62. The "lower surface" and "upper surface" faces connect the leading edge 60 to the trailing edge 62 and an average camber (noted 64 on FIG. 5) is defined equidistant from these two faces.

The platform 34 for fixing the vane 26 to the wall of the casing may have a general form of a plate. It may include at least one or two zones of lesser thickness 52, and possibly a zone of higher thickness 54. The zone of higher thickness 54 may be surrounded by a zone of lesser thickness 52, or be arranged between two zones of lesser thickness 52. The fixing pin 36 may extend from the platform in an opposite direction than the airfoil 50 of the vane. The or each platform 34 comprises an external radial support surface 56 intended to face a facet.

Figure 5:
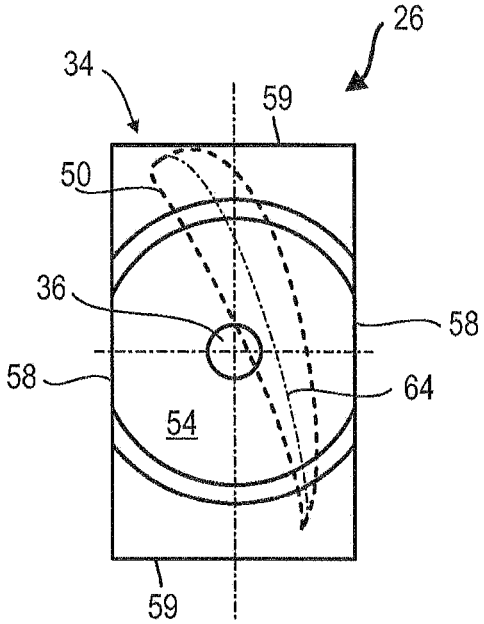
FIG. 5 shows a top view of the vane.

FIG. 5 represents a model of a vane platform seen radially from the outside (or seen from above relative to the view in FIG. 4). The airfoil 50 of the vane which is on the other side of the platform 34 is shown in dotted lines. Platform models can change from one row of vanes to another.

The platform 34 may have a generally quadrilateral shape such as a parallelogram, a trapezoid or a rectangle. The outline of the platform 34 includes opposite lateral edges 58, which can possibly come into contact with lateral edges 58 of other neighboring vanes in the same row, and upstream and downstream edges 59. The lateral edges 58 can be bent or arched to limit their rotation when tightening the fasteners.

The platform 34 is made of metal, preferably titanium. It can also be made of an organic matrix composite. It may be integrally made with the airfoil of the vane 26. To respect a precise shape, its outline is machined, possibly grinded in order to meet strict tolerances.

The higher-thickness area 54 may have the shape of a disc, the fixing pin 36 possibly being arranged in the center of the disc and/or of the rectangle. Alternatively, the pin 36 can be arranged eccentrically and not in the center of the platform. For example, the center of the pin 36 can be at a distance of 20 to 50% of the axial dimension of the platform on the upstream side. The pin 36 can be arranged in the first half or the first upstream third of the platform.

FIG. 6 represents a stator vane 26 fixed to the wall 32.

The wall 32 may have a generally constant thickness, for example at the level of at least one or each facet 42. Its external surface 70 may be curved at the level of each facet 42, preferably with a continuous curvature and/or monotonic axially and/or circumferentially in line with each facet 42. Alternatively, the external surface 70 of the wall 32 may comprise a flat portion 72 at the position opposite the facet 42. One or each flat portion 72 can be parallel to the associated facet 42. A flat portion 72 forms a flat surface, possibly smooth. It can form a discontinuity in the curvature of the external surface 70. The flat surface provides a surface for a means of tightening 74 of the fixing pin 36, preferably a nut 74 on a threaded pin 36.

The external radial surface 56 of the or each platform 34 is opposite the facet 42. This surface 56 and this facing facet 42 may be parallel and of substantially similar dimensions. Alternatively the surfaces 42, 56 can be inclined with respect to one another. The surface 56 of the platform may not be flat.

The higher thickness area 54 comes into contact with the facet 42 and the pin 36 enters the orifice (noted 46 in FIG. 3) of the facet 42.

A layer of abradable material 38 can be inserted between surfaces 42 and 56. The abradable material 38 can extend unto the edges of the platform or be at an axial distance from it.

The or each facet 42 forms a discontinuity in the internal surface 40. The outline of at least one or each facet 42 can form a line of rupture of the curvature of the internal surface. All around each facet 42, the tangents of the internal surface can be inclined with respect to the facet 42. The facets 42 can form flattenings in the internal surface 40, the flattenings being inwards. The wall has a continuity of material between the facets and the internal surface, and possibly a geometric discontinuity.

Between the facet 42 and the surface 56 is provided a gasket 80 made of elastic material to prevent air leaks between the platform and the casing. A pocket 68 is delimited by the gasket 80, by the external radial surface 56 of the platform 34 and by the wall 32 of the casing.

Although the example illustrated shows a casing with facets, the casing may not be provided with facets and the surface 56 therefore faces the tubular or cylindrical wall 32.

The gasket can be made of bars. Its external outline can correspond at least partially to the outline of the surface 56 and therefore be in the form of a polygon, in particular trapezoid, parallelogram or rectangle. Three of the segments of the gasket 82, 84, 86 forming the polygon are visible in FIG. 6. Alternatively, the gasket may comprise planar portions.

One or both surfaces 42 and 56 may have recesses, for example grooves to receive one or more segments of the gasket 80.

FIG. 7 depicts the gasket 80 in this same embodiment. The gasket 80 has a frame 81 composed of upstream 82 and downstream 84 outer segments and axial outer segments 86, 88 forming a rectangle.

The gasket may further comprise an toric portion 90 preferably connected to the frame 81 by segments arranged at 90°, in particular in this example two axial segments 92, 94 and two circumferential segments 96, 98 (i.e. which extend mainly along the circumference). The toric portion 90 can be connected to the frame 81 by means of a cross, in particular formed by the segments.

In this example, the toric portion 90 is in the center of the gasket 80. It can alternatively be offset upstream or downstream, i.e. closer to the segment 82 or 84 respectively. The toric portion 90 can also be offset circumferentially, i.e. closer to segment 86 or segment 88.

Preferably, the section of the circumferential segments 96, 98 is greater than the section of the segments 92, 94. If the segments are all of the same thickness—the thickness being their dimension in the radial direction which is perpendicular to the plane of FIG. 7—, the section of the circumferential segments 96, 98 is larger because of their dimension in the axial direction which is larger than the circumferential dimension of the segments 92, 94.

The thickness of the downstream segment 84 of the frame 81 may be greater than the thickness of the upstream segment 82 of the frame 81.

FIG. 8 shows an isometric view of a gasket 180 according to a second embodiment. The referral numbers of the gasket 180 are incremented by 100 relative to that of FIG. 7.

In this example, the toric portion 190 is connected to the frame 181 formed by the bars 182, 184, 186, 188 only by three segments 192, 196 and 198. This example shows in particular the thickness variation the along the gasket 180. The downstream segment 184 in particular has a greater thickness than the upstream segment 182. This allows a greater compression ratio of the gasket 180 downstream when the surfaces 42 and 56 are parallel. This also allows the mounting of a gasket between two surfaces 42 and 56 which are not parallel, the variable thickness of the gasket compensating the variable distance between the two surfaces 42 and 56.

Figure 9:
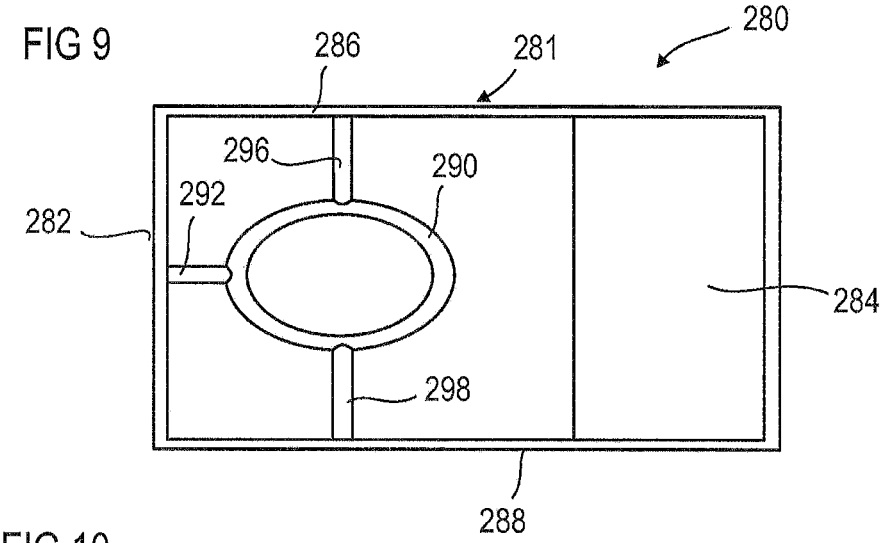
FIG. 9 shows a third embodiment of the gasket.
Figure 10:
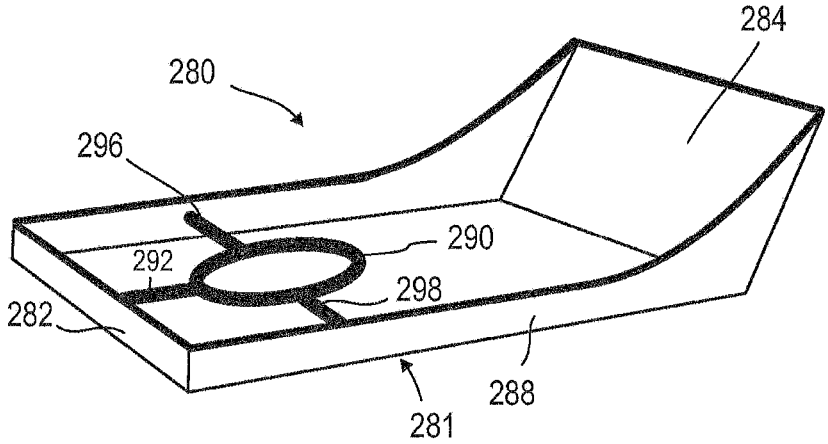
FIG. 10 shows an isometric view of the gasket of FIG. 9.

FIGS. 9 and 10 describe a gasket 280 according to a third embodiment. The referral numbers of the gasket 280 are incremented by 100 relative to that of FIG. 8. The toric portion 290 has an oval shape and is not placed in the middle of the gasket but in the upstream half. The toric portion 290 is connected to the frame 281 by the circumferential segments 296, 298 and the axial segment 292. In replacement of the downstream segment is provided a reinforcement strip 284. FIG. 10 illustrates this strip 284 and highlights the significant variation of the thickness of the gasket between upstream and downstream. The strip 284 can also complement a downstream segment (like segment 184 of the previous embodiment), the strip extending upstream or downstream from such a segment, possibly at a distance therefrom. The frame 281 is formed by the segments 282, 286, 288 and the strip 284.

The gaskets of two adjacent platforms can come into contact with each other. The axial outer segments 86, 88, 186, 188, 286, 288 of two adjacent platform gaskets may be parallel and come into contact with each other.

A platform can have one side of the outline parallel to one side of an adjacent platform and come into contact on this side.

Figure 11:
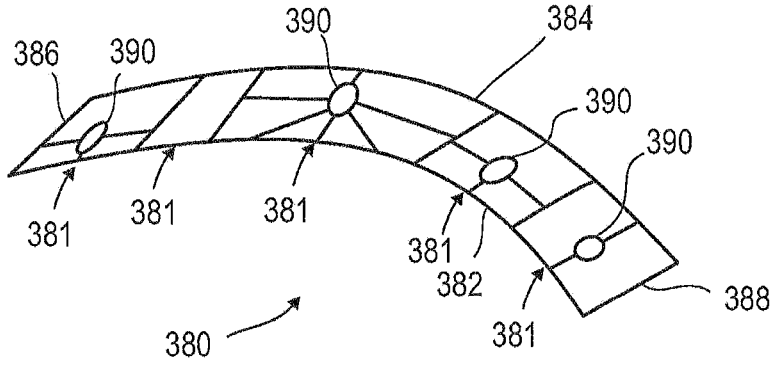
FIG. 11 shows a fourth embodiment of the gasket.

Alternatively, as shown in FIG. 11, two or more adjacent gaskets can form a single gasket 380 common to several platforms.

This gasket 380 includes an upstream segment 382 and a downstream segment 384 common to several platforms. Toric portions 390 are provided to each circumcise the fixing pin of the respective platforms and interior segments are provided to connect the toric portions 390 to the upstream 382 and downstream segments 384. The arrangement of the toric portions 390 and the respective interior segments corresponds to the outline of the platforms. Thus, some of the toric portions can be positioned at different places axially, and the dimension of the gasket portions facing a platform can be more or less wide. The fact that the gasket 380 is not symmetrical can serve as a mechanical coding during the assembly of the turbomachine.

The gasket can follow the polygonal outlines of each of the adjacent vane platforms. The gasket is therefore formed by several frames 381 and two adjacent frames can share a segment in common.

Such a gasket 380 can cooperate with several vanes of the annular row of vanes, such as for example two or four adjacent vanes, or all the vanes opposite a half-casing. Alternatively, a gasket can cooperate with a plurality of adjacent vanes, at least one of which is fixed to a half-casing and at least one other is fixed to the other half-casing. The gasket can also be common to all the vanes of a row of vanes and be in the form of a crown.

Figure 12:
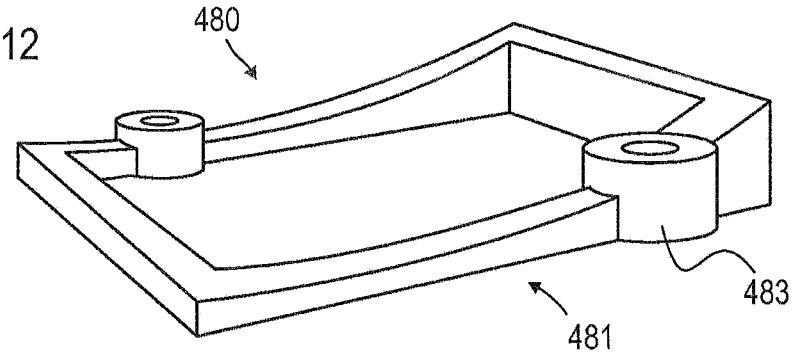
FIG. 12 shows a fifth embodiment of the gasket.
Figure 13:
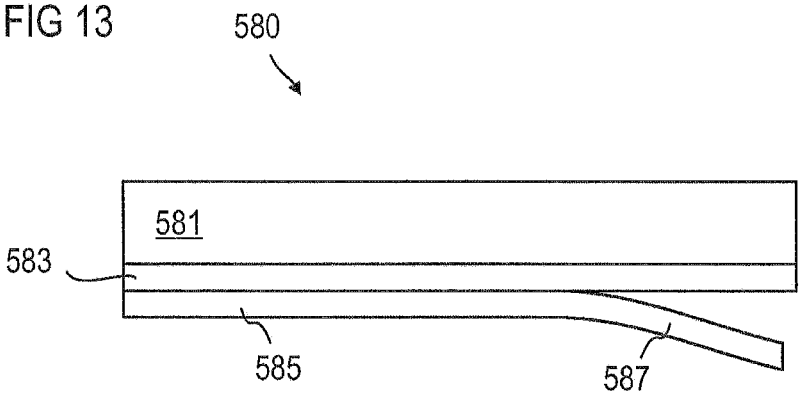
FIG. 13 shows a sixth embodiment of the gasket.

FIGS. 12 and 13 illustrate a gasket 480, 580 according to the invention. This may have the various elements already described in the other embodiments (toric portion, tongue, a single gasket common to several platforms, etc.).

In addition, the gasket 480 has thermoformed studs 483, produced as molding inserts. These studs 483 are preferably arranged at the frame 481 of the gasket. Alternatively, one or more studs can be placed at other locations of the gasket 480. These studs can include a hole which can cooperate with pins provided on the platform. The pins can be such that a tight assembly in the studs is obtained. This allows the gasket to be pre-assembled on the platform. The studs can alternatively be provided with a tapping to receive a threaded rod of the platforms. There are 2, 4 or 6 studs. The studs can be of identical or different dimensions, in particular when the gasket is thicker downstream as shown in FIG. 12. Alternatively, a single stud can also be provided on the gasket.

FIG. 13 represents a gasket 580 provided with an adhesive element 583 on its frame 581. The elements are shown schematically and the scale is not respected. The adhesive element can be glue or an adhesive layer 583, which can be covered with a lid 585. During assembly, the lid 585 is removed from the gasket 580, then the gasket is positioned on the platform. To this end, the lid has a portion 587 which is not adherent with adhesive means in order to facilitate its removal.

Thus, the gasket adheres to the platform and facilitates the mounting of the platform with its gasket in the casing.

The gasket of the various embodiments illustrated above can be made completely of elastomer, polymer or foam. One or more of the segments may comprise a rigid wire (metallic or other) embedded or coated with elastomer, polymer or foam.

The different details of the different embodiments set out in the present application can be combined unless it is explicitly described as alternatives and such a combination is made mechanically impossible.

The invention claimed is:

1. An assembly for an axial turbomachine, the assembly comprising:

a casing of annular shape and with an internal surface;

an annular row of stator vanes with at least one stator vane comprising an airfoil extending radially from a fixing platform, said fixing platform being fixed to the casing and having a polygonal outline; and a gasket, distinct from the casing and the fixing platform, and comprising a frame whose outline matches the polygonal outline of the fixing platform, said frame being in radial contact with the fixing platform and with the casing in order to ensure a sealing between the fixing platform and the casing, wherein the fixing platform has a fixing pin which passes through an orifice of the casing, and the fixing pin extends through the gasket; and wherein a portion of the gasket has the shape of a tore or a cylinder and surrounds the fixing pin.

2. The assembly according to claim 1, wherein the frame defines a pocket radially between the fixing platform and the casing, said pocket extending substantially over the fixing platform.

3. The assembly according to claim 1, wherein the fixing platform has sides, and the frame is formed by bars running along the sides of the platform.

4. The assembly according to claim 3, wherein segments are provided to connect the portion of the gasket that has the shape of a tore or a cylinder to the frame.

5. The assembly according to claim 4, wherein the segments comprise two circumferential segments oriented along a circumferential direction and at least one axial segment oriented along an axial direction.

6. The assembly according to claim 1, wherein the frame of the gasket has an external shape having a shape of a parallelogram or a rectangle.

7. The assembly according to claim 1, wherein the toric or cylindrical portion is arranged in an upstream half of the gasket.

8. The assembly according to claim 1, wherein the frame forms a closed loop along the polygonal outline of the fixing platform.

9. The assembly according to claim 1, wherein the gasket comprises a downstream reinforcing strip.

10. The assembly according to claim 1, wherein the gasket is at least partly made of foam material, polymer material or elastomer material.

11. An assembly for an axial turbomachine, the assembly comprising:

a casing of annular shape and with an internal surface;

an annular row of stator vanes with a plurality of circumferentially adjacent stator vanes each comprising an airfoil extending radially from a respective fixing platform, said fixing platforms being fixed to the casing and each having a respective polygonal outline; and a gasket, distinct from the casing and the fixing platforms, and comprising a frame which extends along the polygonal outlines of each of said fixing platforms and outline matches the polygonal outlines of each of the fixing platforms, said frame being in radial contact with each of the fixing platforms and with the casing in order to ensure a sealing between each of the fixing platforms and the casing.

12. The assembly according to claim 11, wherein the casing comprises an internal surface with a annular row of facets abutting the circumferentially adjacent vanes, the radially external surface of the respective fixing platforms being slanted with respect to the respective facet and the radial thickness of the gasket being higher in a downstream portion of the gasket than in an upstream portion of the gasket.

13. An assembly for an axial turbomachine, the assembly comprising:

a casing of annular shape and with an internal surface;

an annular row of stator vanes with at least one stator vane comprising an airfoil extending radially from a fixing platform, said fixing platform being fixed to the casing and having a polygonal outline; and a gasket, distinct from the casing and the fixing platform, and comprising a frame whose outline matches the polygonal outline of the fixing platform, said frame being in radial contact with the fixing platform and with the casing in order to ensure a sealing between the fixing platform and the casing;

wherein the gasket is radially pre-stressed between the fixing platform and the casing, the gasket being more radially compressed in a downstream portion than in an upstream portion.

14. The assembly according to claim 13, wherein the gasket comprises thermoformed studs.

15. The assembly according to claim 14, wherein the thermoformed studs are moulding inserts of the gasket.

16. The assembly according to claim 14, wherein the thermoformed studs have a through-hole receiving pins arranged on the fixing platform.

17. The assembly according to claim 13, wherein an adhesive layer arranged on the frame to adheres the gasket to the fixing platform.

* * * * *